US007258333B2

(12) United States Patent
Hobday

(10) Patent No.: US 7,258,333 B2
(45) Date of Patent: Aug. 21, 2007

(54) CLAMPING DEVICE

(76) Inventor: Harold William Hobday, 124 5th St., Galt, CA (US) 95632

( * ) Notice: Subject to any disclaimer, the term of this patent is extended or adjusted under 35 U.S.C. 154(b) by 0 days.

(21) Appl. No.: 11/050,125

(22) Filed: Feb. 3, 2005

(65) Prior Publication Data

US 2006/0290041 A1 Dec. 28, 2006

(51) Int. Cl.
*B25B 1/00* (2006.01)

(52) U.S. Cl. ..... 269/6; 269/3; 269/166

(58) Field of Classification Search ..... 269/3–6, 269/95, 166–171.5

See application file for complete search history.

(56) References Cited

U.S. PATENT DOCUMENTS

| | | | | |
|---|---|---|---|---|
| 6,367,787 | B1 * | 4/2002 | Poole et al. | 269/6 |
| 6,386,530 | B1 * | 5/2002 | Marks | 269/6 |
| 6,655,670 | B1 * | 12/2003 | Liou | 269/6 |
| 6,676,120 | B1 * | 1/2004 | Hallbeck et al. | 269/6 |
| 6,746,006 | B2 * | 6/2004 | Thomas | 269/6 |
| 6,929,253 | B2 * | 8/2005 | Marks | 269/6 |
| 2005/0121842 | A1 * | 6/2005 | Lo | 269/6 |
| 2006/0043660 | A1 * | 3/2006 | Ping | 269/6 |
| 2006/0091596 | A1 * | 5/2006 | Marusiak | 269/6 |

* cited by examiner

*Primary Examiner*—Lee D. Wilson

(57) ABSTRACT

An improved bar clamp in which the first jaw assembly consists of a handle assembly or setting unit, on a slide bar inside of an independently mounted first jaw. A finger lever is pivotably attached to the setting unit and at its upper end pivotably attached to the first jaw. A braking lever is included in the first jaw, and a driving lever in the setting unit. Upon first movement of the finger lever a spring forces the driving lever into firm contact with the slide bar, preventing movement of the first jaw away from the second jaw. The finger lever has no further contact with the driving lever, but upon further movement, acts indirectly on the driving lever via the handle assembly to draw the slide bar and the second jaw towards the first jaw. Releasing the finger lever draws the handle unit forward for the next cycle. Release of the braking lever in the first jaw allows movement away from the second jaw. Close proximity of the two pivots gives increased leverage over conventional designs, achieving practical clamping pressure with less effort as well as greater holding power when maximum grip is applied. An improved second jaw, consisting of a body, molded in two opposing sections, and including a braking lever and a spring to bias it into full contact with the slide bar. The self-aligning part holding the pad bears against a spring, and after firm contact with a workpiece the second jaw and the slide bar continue to be drawn toward the first jaw, stressing the spring. The spring minimizes the loss when the finger lever is released and the clamping force is transferred to the braking lever in the first jaw.

5 Claims, 4 Drawing Sheets

CLAMPING DEVICE

DETAILED DESCRIPTION OF THE DRAWINGS

Figure 1:
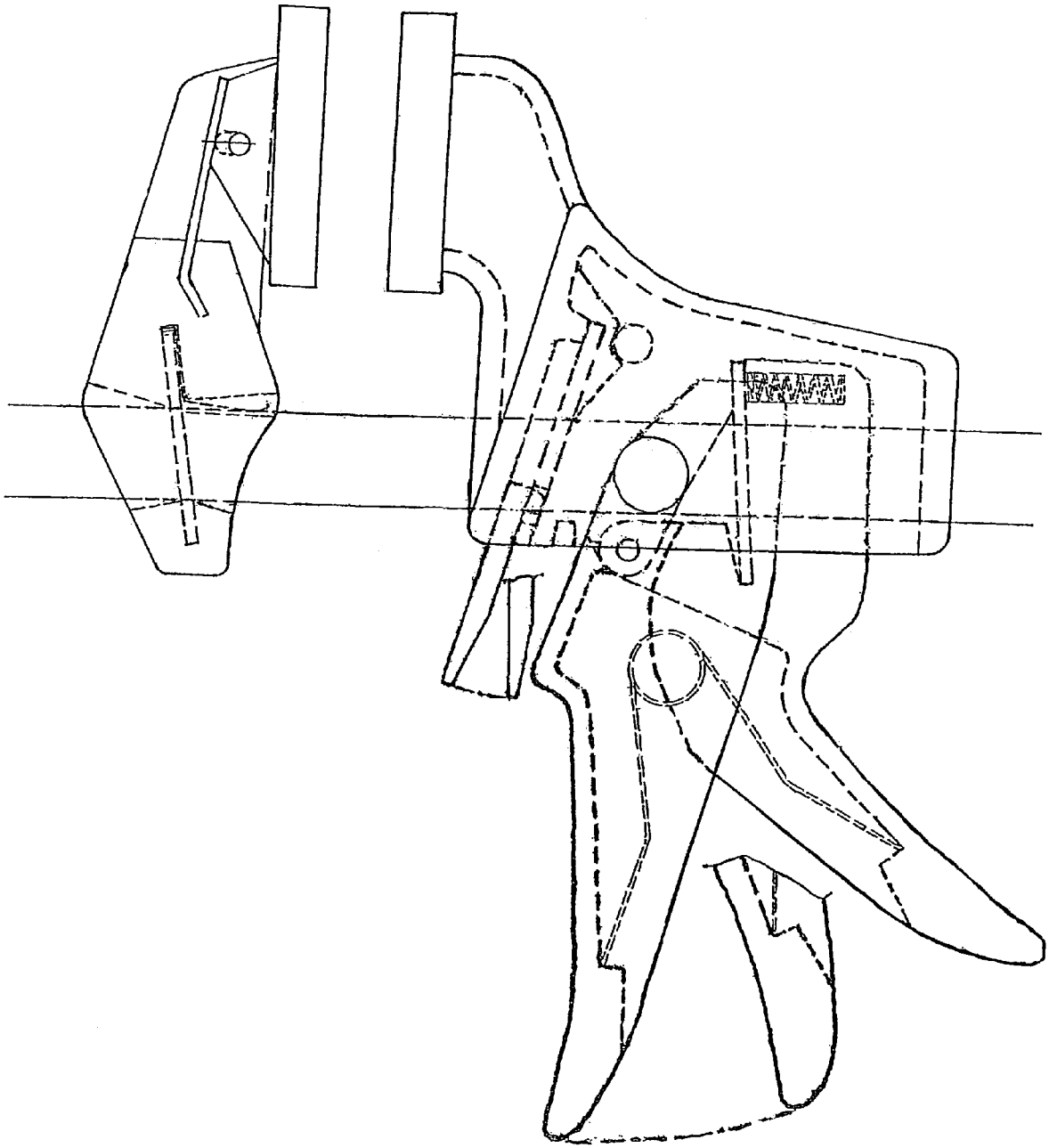
FIG. 1 is a sectional side view of a clamp according to the present invention.
Figure 2:
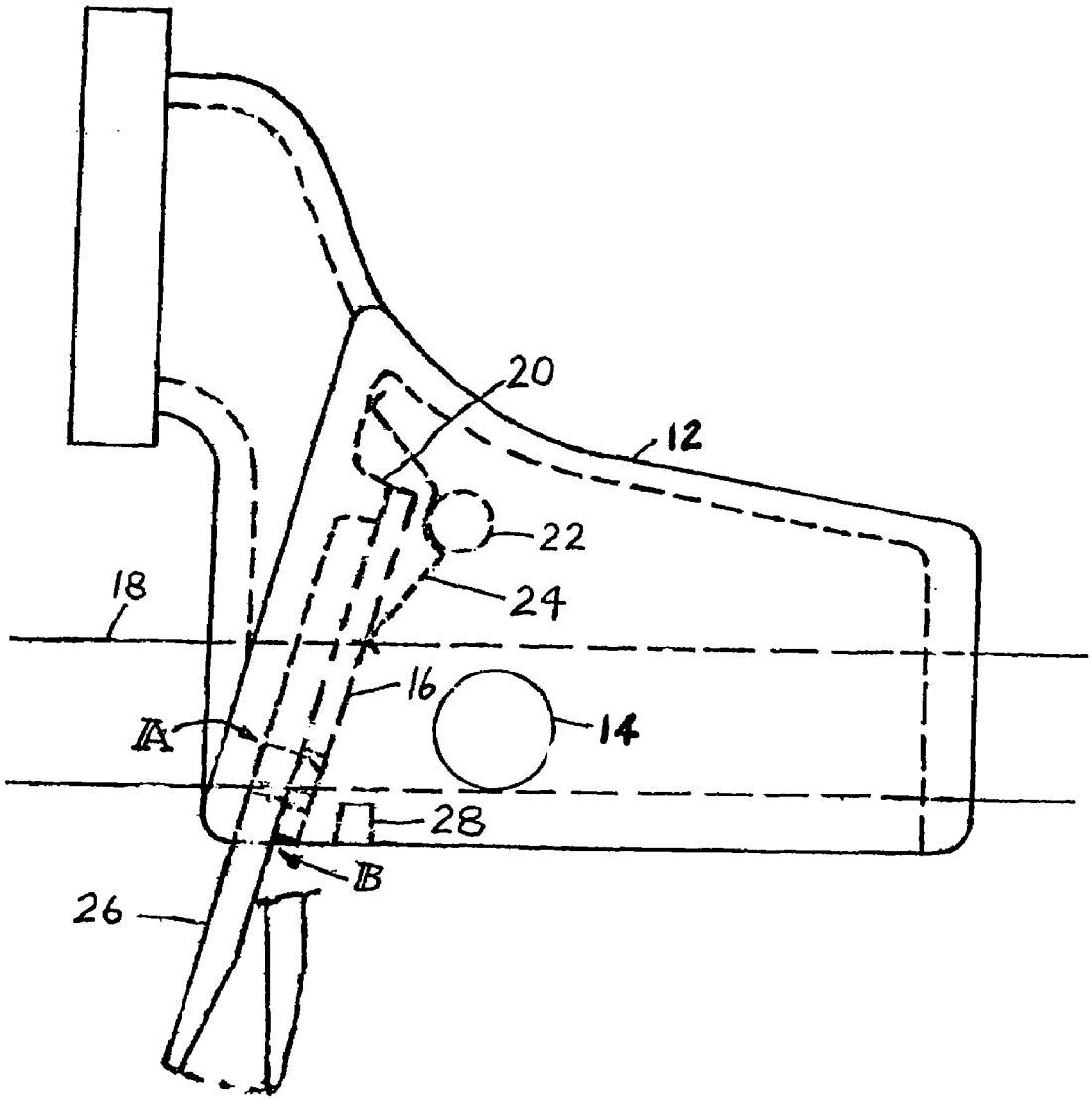
FIG. 2 is a sectional side view of a clamp jaw according to the present invention.
Figure 3:
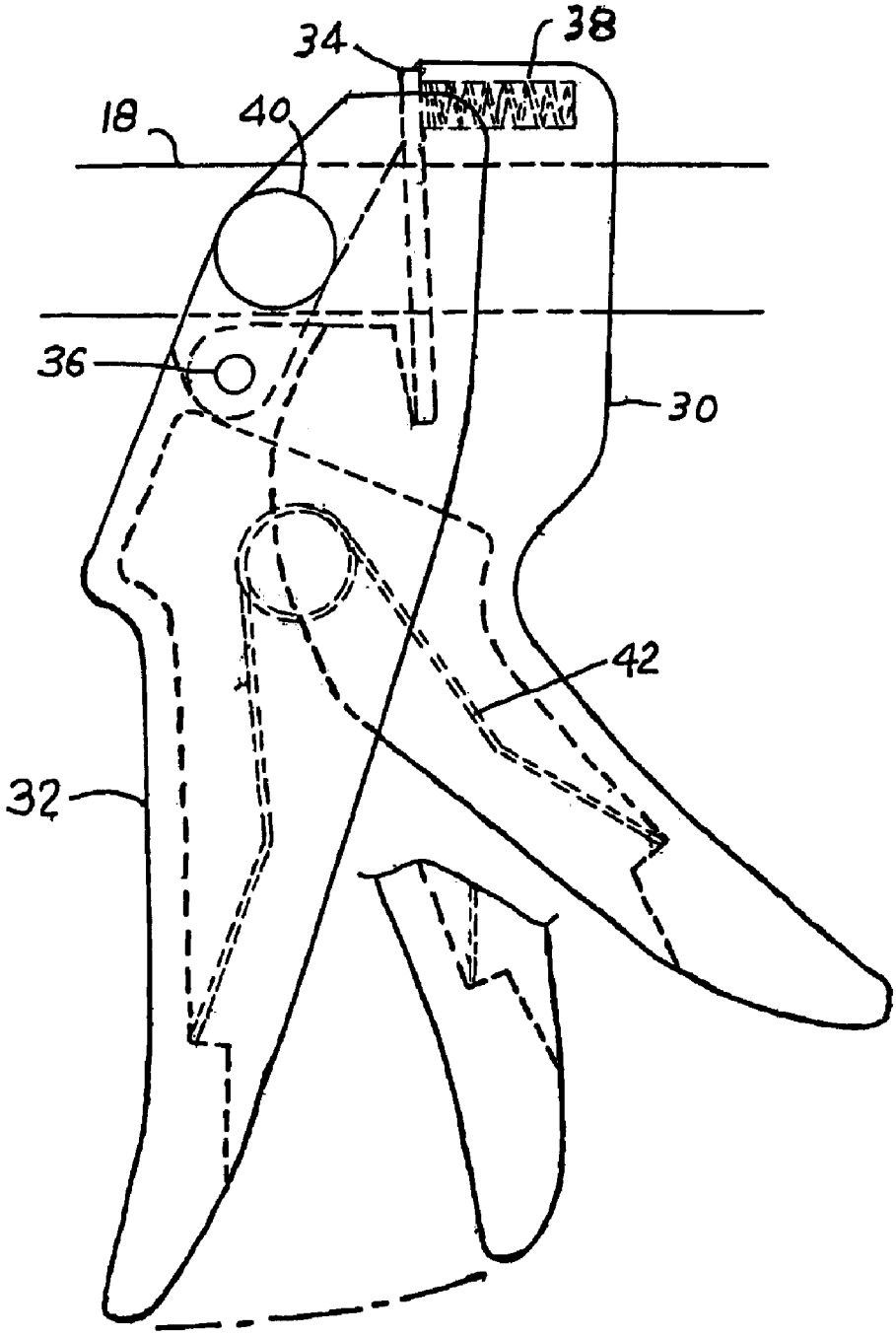
FIG. 3 is a sectional side view of a clamp jaw according to the present invention.
Figures 4, 5, 6:
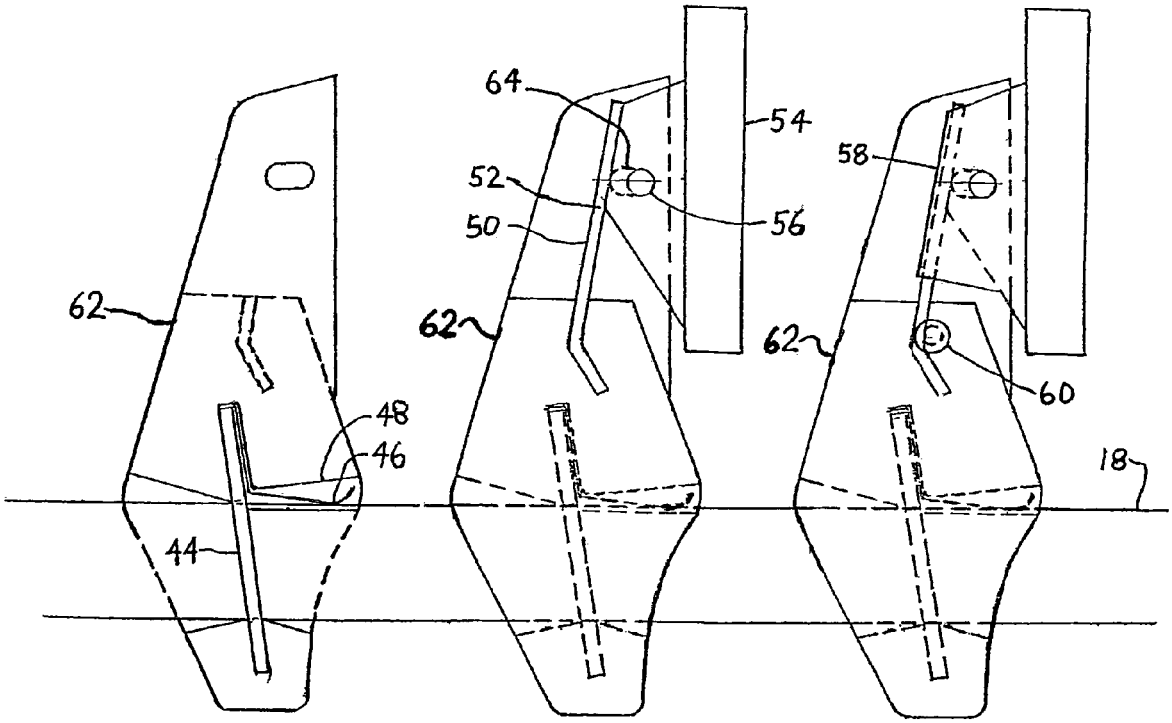
FIG. 4 is a sectional side view of a clamp jaw according to the present invention.
FIG. 5 is a sectional side view of a clamp jaw according to the present invention.
FIG. 6 is a sectional side view of a clamp jaw according to the present invention.

FIG. 1 shows a new bar clamp, with the first jaw described in FIGS. 2 and 3 and the new second jaw described in FIGS. 4, 5, and 6.

In FIG. 2 the clamp body 12, is formed in two opposing sections, wide enough to install the handle assembly 30 shown in FIG. 3, loosely on the bar within its confines. The braking lever in the normal position precludes movement of the first jaw away from the second jaw. The braking lever 16, has a slot of such dimensions that both ends of the slot are in contact with the slide bar 18, when the braking lever is in the normal position. The braking lever 16 is supported at the opposed end by an abutment 20, molded into the clamp body. Molded extensions 22, on the inside of the clamp body support a flat spring 24, that biases the braking lever into the normal position. The release lever 26, is located between the braking lever 16, and the front wall of the clamp body 12. Pulling on the release lever 26 applies pressure at points A and B, prying the braking lever 16 loose from its grip on the slide bar 18. The release lever 26 is notched to clear the slide bar 18, and is positioned by mating notches in either side of the braking lever 16. A stop bar 28, integral to the inner wall of the clamp body 12, limits the movement of the braking lever 16 when force is applied by the release lever 26. The release lever 26 is fitted loosely, so as not to interfere with the seating of the braking lever 16 in the normal position.

FIG. 3 consists of a handle assembly 30, with a handgrip, 31 and a slide bar 18 passing through on the center line. Moving parts include a finger lever 32, a driving lever 34, a spring 38 to set the driving lever, a pivot pin 36 and a torsion spring 42 that returns the finger lever 32 to the normal position. In the normal position the driving lever 34 is held in a relationship to the slide bar 18 such that the handle assembly 30 can be easily moved in either direction. The circular part, 40 extends outward on both sides of the finger lever 32 and fits into the hole 14 in either side of the clamp body 12, making a pivotable connection of the two units. First movement of the finger lever 32 rotates the upper portion, away from the driving lever 34, and the spring 38, biases the driving lever into full contact with the slide bar 18, effectively preventing movement away from the second jaw. Further movement of the finger lever 32, draws the slide bar 18, and the second jaw toward the first jaw. Releasing the finger lever 32, pulls the handle assembly forward in preparation for the next advancing cycle.

In FIG. 4 the new second jaw 62 shows a braking lever 44, biased into the normal position in full contact with the bar 18 by a spring 46. Clockwise rotation of the unit toward the opposing first jaw further stresses the spring 46, reducing the contact of the braking lever 44 with the slide bar 18, making it easily slideable toward or away from the opposing first jaw. Rotation of a pivotable base is limited by internal structure 48 which also protects the spring. In the preferred embodiment the body of the new second jaw is molded in 2 opposing sections, with the braking lever 44, and the spring 46 dropped into a cavity and putting the other section in place holds the bar and spring securely inside.

In FIG. 5 the loose part holding the pad 54, slotted to fit on either side of the thinner upper section of the second jaw 62, fastened to it by a pin 56, in a slotted hole 64. One end of a spring 50 is anchored in the second jaw 62 and the other end free to resist the pressure applied by the advancing first jaw. A matching spring is installed on the opposite side of the second jaw 62. The applied pressure is concentrated at point 52 making the part fully self-aligning.

In FIG. 6 side extensions 58 reach past the spring 50, effectively keeping the springs in place in their normal position. An alternative is locking the springs in place mechanically, 60.

The invention claimed is:

1. A quick acting bar clamp comprising a first jaw, a second jaw for opposing the first jaw, a slide bar, said second jaw being positioned along the slide bar, the slide bar being movable to bring the second jaw toward and away from the first jaw;

a support means for supporting the slide bar, the first jaw being connected to the support means, including the one way drive means for releaseably engaging and, when engaged, for advancing the slide bar and the second jaw, the second jaw being subject to advancement toward the first jaw when the one way drive means is actuated;

the one way drive means having a driving lever, and a braking lever normally engaging the slide bar, the braking lever when engaging the slide bar preventing motion of the second jaw away from the first jaw, and when disengaging the slide bar allowing advancement of the second jaw away from the first jaw, the braking lever having an auxiliary release lever extending outward from the first jaw; support means including a hand grip, a trigger type relationship existing between the finger lever and the hand grip, the bar clamp being holdable at said hand grip, the release lever and the finger lever being selectively operable by the same hand in such a manner that one of the index and middle fingers is positioned on engaging portion of the release lever to release the braking lever while the other fingers encircle and contain the finger lever and the handgrip; wherein said finger lever pivots about a circular part.

2. A first jaw comprising two opposing sections, having a top, front and rear inner wall, and two sides, with slotted holes at each end proximal to the open bottom to allow passage of a slide bar, and having a round hole in each side with a circular part extending outwardly to facilitate pivotable attachment of a finger lever;

the first jaw including a clamping surface;

a braking bar parallel to the front face, the braking bar held by means of a flat spring that is supported by brackets in the inner sides of the first jaw;

the first jaw supporting a release lever positioned between the braking lever and the front wall, held in place by interaction with notches in the sides of the braking bar, said release lever extending downward whereby actuating the release lever pries the braking lever free from the slide bar, allowing free movement of the first jaw in either direction on the slide bar.

3. A quick acting bar clamp comprising a first jaw, a second jaw for opposing the first jaw, a slide bar, said second jaw being positioned along the slide bar, the slide bar being movable to bring the second jaw toward and away from the first jaw; wherein the second jaw, comprised of two opposing sections, that mated together having an internal horizontal slot to accommodate the slide bar, and a near vertical slot to hold a braking lever, the slot at the top slanted away from the opposing first jaw, and above the slide bar the braking lever shares a cavity with a spring, the spring being on the forward side of the braking lever, the spring being stressed to bias the braking lever into contact with the slide bar, whereby releasing said stress biasing the breaking lever allows the second jaw to move toward or away from the first jaw; inner structure limits movement during said release of said stress, protecting the spring, and inner relief allows the second jaw to move toward the first jaw, removed from the slide bar or reinstalled as a spreader.

4. A quick acting bar clamp comprising a first jaw, a second jaw for opposing the first jaw, a slide bar, said second jaw being positioned along the slide bar, the slide bar being movable to bring the second jaw toward and away from the first jaw; wherein the second jaw comprises a clamping surface on a pivotable base with a slot allowing limited movement toward and away from the first jaw.

5. A quick acting bar clamp comprising a first jaw, a second jaw for opposing the first jaw, a slide bar, said second jaw being positioned along the slide bar, the slide bar being movable to bring the second jaw toward and away from the first jaw; wherein the second jaw has an upper section comprising a housing and a spring or springs on the upper section that are anchored in said upper section; such that after initial contact is made with a workpiece the second jaw and the slide bar continue to be drawn toward the first jaw, deflecting or compressing the spring or springs; the spring or springs minimizing the loss of clamping force when a finger lever is released and transferring the clamping force to the braking lever in the first jaw.

* * * * *